United States Patent [19]

Saunders

[11] 4,387,657

[45] Jun. 14, 1983

[54] CENTERBOARD SNUBBER

[76] Inventor: Bayard K. Saunders, 2685 Woodside Rd., Bethlehem, Pa. 18017

[21] Appl. No.: 287,292

[22] Filed: Jul. 27, 1981

[51] Int. Cl.[3] ..... B63B 41/00

[52] U.S. Cl. ..... 114/132; 114/140; 114/126

[58] Field of Search ..... 114/126–143, 114/39, 65 R, 356; 441/79

[56] References Cited

U.S. PATENT DOCUMENTS

| | | | |
|---|---|---|---|
| 3,314,390 | 4/1967 | Young | 114/127 |
| 3,516,100 | 6/1970 | Ellis | 441/79 |
| 3,871,322 | 3/1975 | Dodge | 114/127 |

FOREIGN PATENT DOCUMENTS

| | | | |
|---|---|---|---|
| 2738070 | 3/1979 | Fed. Rep. of Germany | 114/130 |
| 2019785 | 11/1979 | United Kingdom | 114/39 |

*Primary Examiner*—Trygve M. Blix
*Assistant Examiner*—Stephen P. Avila
*Attorney, Agent, or Firm*—Zachary T. Wobonsmith; Zachary T. Wobonsmith, III

[57] ABSTRACT

A centerboard snubber is disclosed for use in a sailboat equipped with a weighted centerboard or a swing keel in order to prevent the weighted centerboard or swing keel from retracting into its trunk under the force of gravity, the force of passing water, or such forces combined, during excessive heeling of the sailboat in either direction thereby retaining the stability and self righting capability of the sailboat provided by the extended weighted centerboard or the extended swing keel.

4 Claims, 13 Drawing Figures

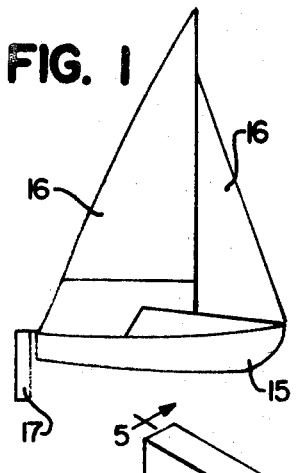
FIG. 1
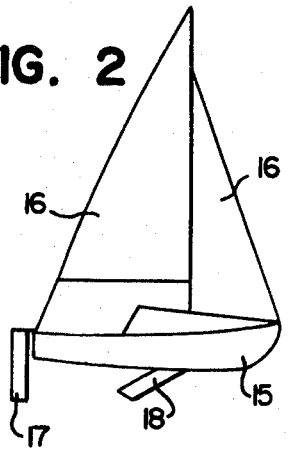
FIG. 2
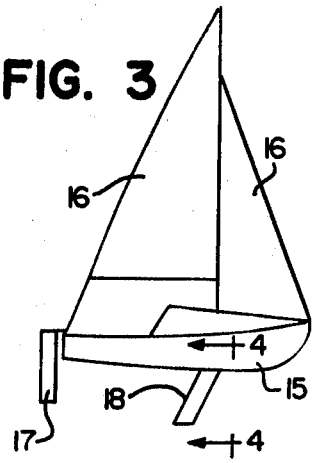
FIG. 3
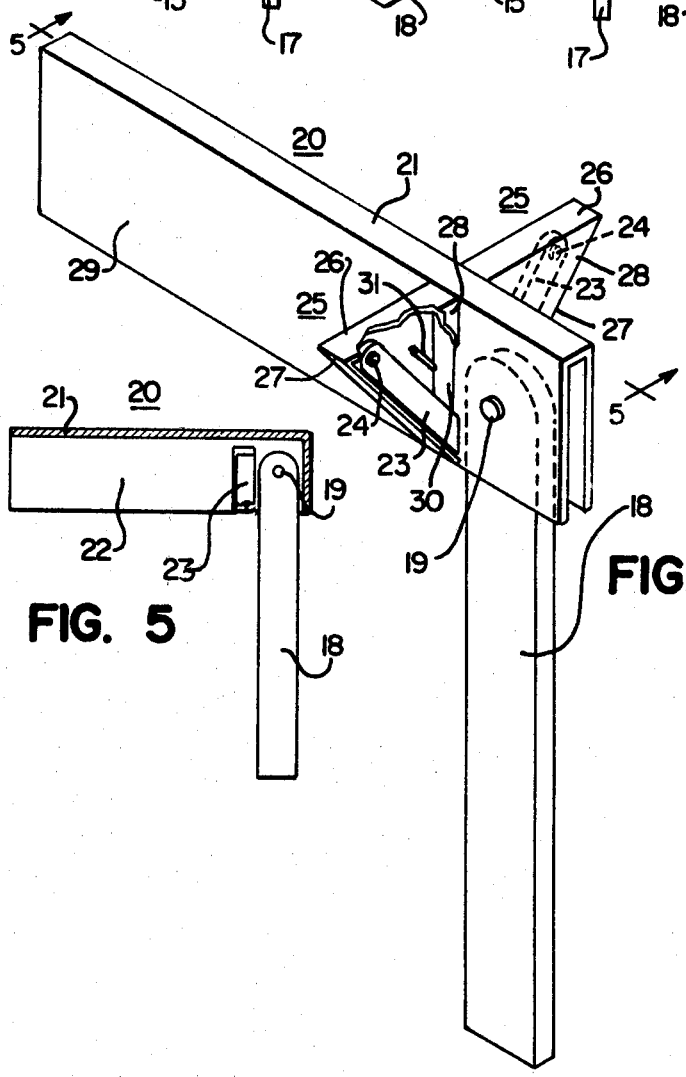
FIG. 4
FIG. 5

FIG. 6
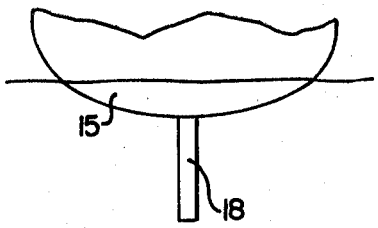
FIG. 8
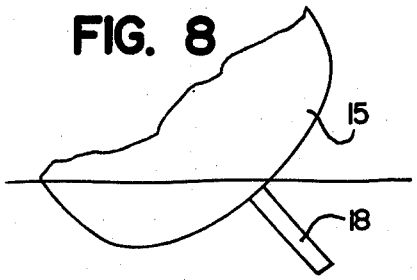
FIG. 10
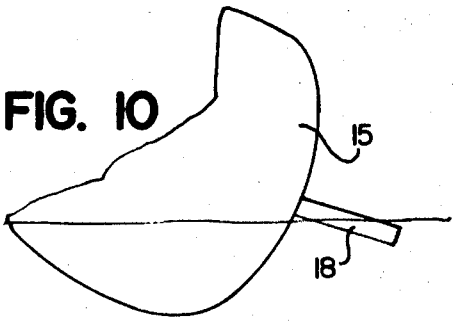
FIG. 7
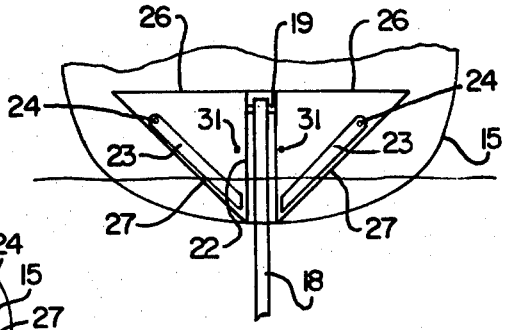
FIG. 9
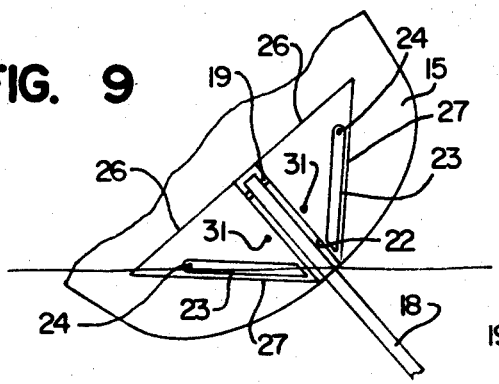
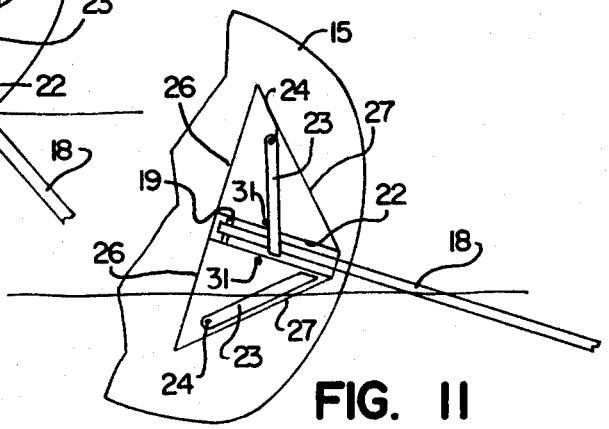
FIG. 11

CENTERBOARD SNUBBER

BACKGROUND OF THE INVENTION

1. Field of the Invention

This invention relates to a centerboard snubber for preventing retraction of a weighted centerboard or a swing keel into its trunk upon excessive heeling.

2. Description of the Prior Art

Young, in U.S. Pat. No. 3,314,390 shows a centerboard snubber for use with an adjustable centerboard 1 for sailboats positioned within a centerboard housing 2. A releasable locking means 3 is mounted on the centerboard housing 2 and includes a substantially rigid moveable arm 4 pivotally mounted on one side of the housing 2. The arm 4 carries rollers 24, 25 of soft rubber for engagement with the centerboard 1, a spring 23 normally urging the rollers 24, 25 into engagement with the centerboard 1 thereby frictionally locking, jamming, and holding the centerboard 1 in place against downward movement. An upstanding lower end tab portion 22, and manually operable, when depressed swings the arm 4 out of contact with the centerboard 1 to permit lowering of the centerboard 1.

Dodge, in U.S. Pat. No. 3,871,322 shows a snubber for the dagger board of a sailboat. A small sailboat is shown at 10 having a retractable keel or daggerboard 11 movable vertically in a dagger board trunk 13. To keep the dagger board 11 at a desired elevation, a snubber 23 is provided which includes two spaced fins 25 secured to the top of the trunk 13. The fins partially extend over the slot 20 in the trunk 13. The fins 25 are described as formed of a resiliently yieldable material so that the dagger board is gripped and held by friction between the edges of the fins. The dagger board 13 may be adjusted vertically within the slot 20. In FIG. 3 the dagger board 11 is shown in its lowered position while in FIG. 4 the dagger board 11 is shown in its raised position.

The structures of the patents referred to above would not be effective to prevent retraction of a weighted centerboard or a swing keel into its trunk.

SUMMARY OF THE INVENTION

In accordance with the invention, a centerboard snubber is provided for use in a sailboat equipped with a weighted centerboard or a swing keel in order to prevent the weighted centerboard or swing keel from retracting into its trunk under the force of gravity, the force of passing water, or such forces combined during excessive heeling of the sailboat in either direction thereby retaining the stability and self righting capability of the sailboat provided by the extended weighted centerboard or the extended swing keel.

It is the principal object of the invention to provide a plurality of snubber elements for preventing the weighted centerboard or swing keel from retracting into its trunk under the force of gravity, the force of passing water, or such forces combined when the sailboat heels excessively thereby retaining the stability and self righting capability of the sailboat provided by the extended weighted centerboard or the extended swing keel.

It is a further object of the invention to provide pivotally mounted snubber elements that introduce obstruction within the trunk in order to prevent a weighted centerboard or swing keel from retracting into its trunk under the force of gravity, the force of passing water, or such forces combined.

It is a further object of the invention to provide for use with a weighted centerboard or swing keel of a sailboat of a pair of pivotally mounted snubber elements which prevent the weighted centerboard or swing keel from retracting into its trunk under the force of gravity, the force of passing water, or such forces combined upon excessive heeling of the sailboat thereby retaining the stability and self righting capability of the sailboat provided by the extended weighted centerboard or the extended swing keel.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming a part hereof in which:

FIG. 1 is a side elevational view of a typical sailboat in accordance with the invention with the weighted centerboard or swing keel retracted;

FIG. 2 is a view similar to FIG. 1 with the weighted centerboard or swing keel in a partially extended position;

FIG. 3 is a view similar to FIGS. 1 and 2 with the weighted centerboard or swing keel in its most extended position;

FIG. 4 is a fragmentary perspective view taken approximately on the line 4—4 of FIG. 3;

FIG. 5 is a fragmentary sectional view on a reduced scale taken approximately on the line 5—5 of FIG. 4;

FIG. 6 is a fragmentary end elevational view as seen from the front and showing the sailboat hull and the weighted centerboard or swing keel extended;

FIG. 7 is a transverse diagrammatic view showing the sailboat hull, weighted centerboard or swing keel, and the snubber elements in the positions as in FIG. 6;

FIG. 8 is a fragmentary end elevational view similar to FIG. 6 but showing partial heeling;

FIG. 9 is a transverse diagrammatic view showing the sailboat hull, weighted centerboard or swing keel, and the snubber elements in the positions as in FIG. 8;

FIG. 10 is a fragmentary end elevational view similar to FIG. 8 but with excessive heeling; and FIG. 11 is a transverse diagrammatic view showing the sailboat hull, weighted centerboard or swing keel, and the snubber elements in the positions as in FIG. 10.

Figure 4A:
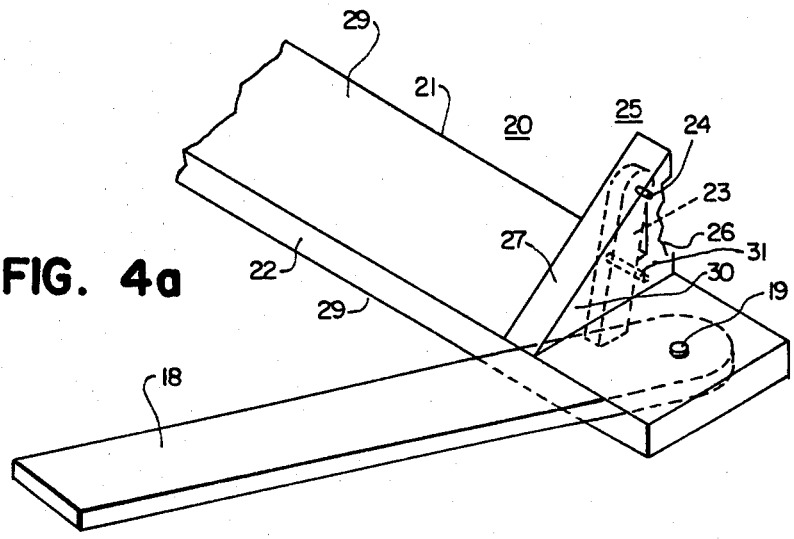
FIG. 4A is a fragmentary perspective view showing the weighted centerboard or swing keel held against retraction as in FIG. 11.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to FIGS. 1, 2 and 3 of the drawings, a typical sailboat hull is shown at 15, with sails 16 and rudder 17. In order to keep the sailboat from side slipping when the sailboat is not sailing in the same direction that the wind is blowing, many sailboat designs provide a retractable centerboard or swing keel 18 shown as pivotally mounted on a pivot pin 19 at the front end of a trunk 20. The trunk 20 is provided as a housing with the interior 22 of sufficient interior length, width and height to accommodate the centerboard or swing keel 18 in its retracted position.

At the option of the sailboat designer, any desired line structure can be employed for retracting and extending the centerboard or swing keel 18, such as a rope or metal cable (not shown) attached to the centerboard or swing keel 18 at any desired location rearwardly of the pivot pin 19, the rope or metal cable having at its upper end any desired raising structure such as a block and tackle or a winch with the line secured in any manner desired such as to a cleat or held by a stopping pawl on a winch.

In many sailboat designs employing a centerboard or swing keel 18 the centerboard or swing keel 18 is made of a heavy material so that the weighted centerboard or swing keel 18 in the extended position gives the sailboat stability and self righting capability. However, with the weighted centerboard or swing keel 18 retracted into its trunk 20, stability and self righting capability are greatly reduced and in some cases eliminated.

In order to prevent the weighted centerboard or swing keel 18 from retracting into its trunk 20 during excessive heeling of the sailboat, snubbers 23 are provided, in a pair, on opposing sides of the trunk 20. The snubbers 23 are of rigid material, of relatively high mass, resistant to shear and compressive forces and to corrosion, and resistant to aquatic growth fouling. The snubbers 23 are pivotally carried on rigid, hard, smooth pivot pins 24, of high shear strength, resistant to corrosion and aquatic growth fouling. The snubbers 23 are disposed within snubber housings 25 that are attached to the opposing sidewalls 29 of the trunk 20 and which housings 25 have inclined sidewalls 27 which limit the swinging movement of the snubbers 23 in an outward direction. The snubber housings 25 have front and rear walls 28. The sidewalls 29 of the trunk 20 have openings 30 to permit the swinging movement of the snubbers 23 into the interior 22 of the trunk 20. Stop pins 31, installed through the front and rear walls 28 of the snubber housing 25, limit inward swinging movement of the snubbers 23. In the event that the trunk 20 is constructed as closed along its top 21, then the tops 26 of the snubber housing 25 should also be constructed as closed.

If the sailboat remains substantially upright as shown in FIGS. 6 and 7 or heels normally as shown in FIGS. 8 and 9 the snubbers do not come into use.

Figure 5A:
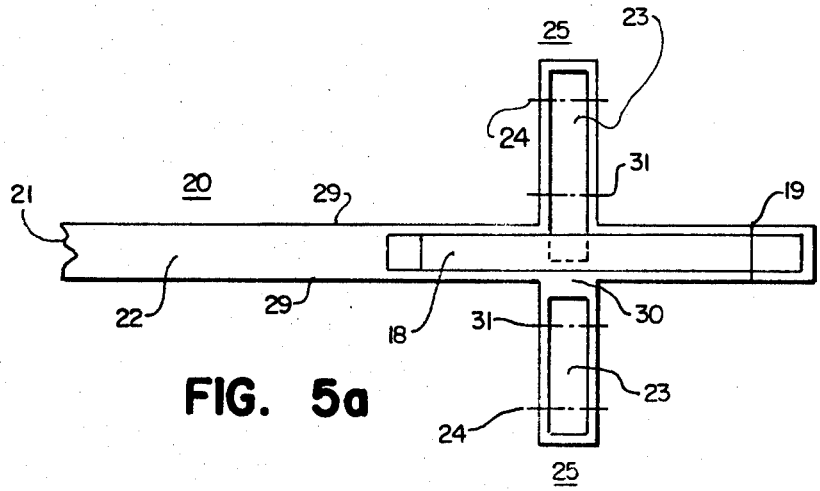
FIG. 5A is a view as seen from below of the weighted centerboard or swing keel held against retraction as in FIGS. 4A and 11.

If however, the sailboat heels to an excessive extent as shown in FIGS. 10 and 11, the snubber 23 on the then upper side will swing to a position in contact with its stop pin 31 across the interior 22 of the trunk 20 as shown in FIGS. 4A and 5A and will block retraction of the weighted centerboard or swing keel 18 into its trunk 20 thereby retaining the stability and self righting capability of the sailboat provided by the extended weighted centerboard or swing keel 18.

I claim:

1. A centerboard snubber for use with a weighted centerboard or swing keel equipped sailboat, the centerboard snubber being equally effective with both weighted centerboards and swing keels for blocking retraction of said weighted centerboard or swing keel into its trunk only upon excessive heeling of the sailboat comprising a pair of snubbers one on each side of said trunk and pivotally mounted at one end, said snubbers being transversely disposed with respect to said trunk and each of said snubbers being swingable upon excessive heeling of said sailboat to a position to block said centerboard or swing keel from retracting into said trunk, said snubbers being mounted within snubber housings, said snubber housings having members for limiting outward swinging movement of said snubbers, said snubber housings having members for limiting inward swinging movement of said snubbers.

2. The combination defined in claim 1 in which said members for limiting outward swinging movement comprise outer inclined walls.

3. The combination defined in claim 1 in which said members for limiting inward swinging movement comprise stop pins.

4. The combination defined in claim 1 in which said members for limiting outward swinging movement comprise outer inclined walls and in which said members for limiting inward swinging movement comprise stop pins.

* * * * *